United States Patent [19]

Alimbau Marques

[11] 4,429,766

[45] Feb. 7, 1984

[54] LADDER CONSISTING OF SLIDING SECTIONS

[75] Inventor: D. Salvador Alimbau Marques, Barcelona, Spain

[73] Assignee: Andral Corporation, Williamsville, N.Y.

[21] Appl. No.: 417,382

[22] Filed: Sep. 13, 1982

[51] Int. Cl.[3] ..... E06C 1/12

[52] U.S. Cl. ..... 182/195; 182/207

[58] Field of Search ..... 182/195, 194, 207

[56] References Cited

U.S. PATENT DOCUMENTS

| | | | |
|---|---|---|---|
| 595,453 | 12/1897 | Fischer | 182/195 |
| 1,712,942 | 5/1929 | Smith | 182/195 |
| 2,534,202 | 12/1950 | McCall | 182/195 |
| 2,542,398 | 2/1951 | Crumpton | 182/195 |
| 2,874,887 | 2/1959 | Pompilio | 182/195 |
| 2,993,561 | 7/1961 | Watson | 182/195 |

*Primary Examiner*—R. P. Machado

*Attorney, Agent, or Firm*—James J. Ralabate

[57] ABSTRACT

A sliding section ladder, comprising sections of varying widths made up of u-shaped modules, comprising a base and upright sections, each module being smaller in width than the one immediately before it, the outer sides of the smaller module backing into the inside of the immediately larger module, whereby the base and upright sections of the u-configuration of the smaller module are adjacent to the u-shaped base and upright sections of the larger module when said ladder is in a closed position.

14 Claims, 5 Drawing Figures

8
4
7
1
7
1'
7
2
3
3
3

LADDER CONSISTING OF SLIDING SECTIONS

BACKGROUND OF THE INVENTION

It is known to have constructed various compact or foldable ladders to be easily transported or stored.

Many of these prior art ladders are too bulky to carry and too complex to become commercially successful. Also many of the compact ladders lack strength and stability and are not reliable supports.

This invention involves a new ladder consisting of sections that slide in relation to each other. It is possible with this invention to construct sliding-section ladders that are simpler, and so lighter, and, therefore, easier to carry on the shoulder from one place to another.

SUMMARY OF THE INVENTION

The description of the present ladder is accompanied by drawings on which

Figure 1:
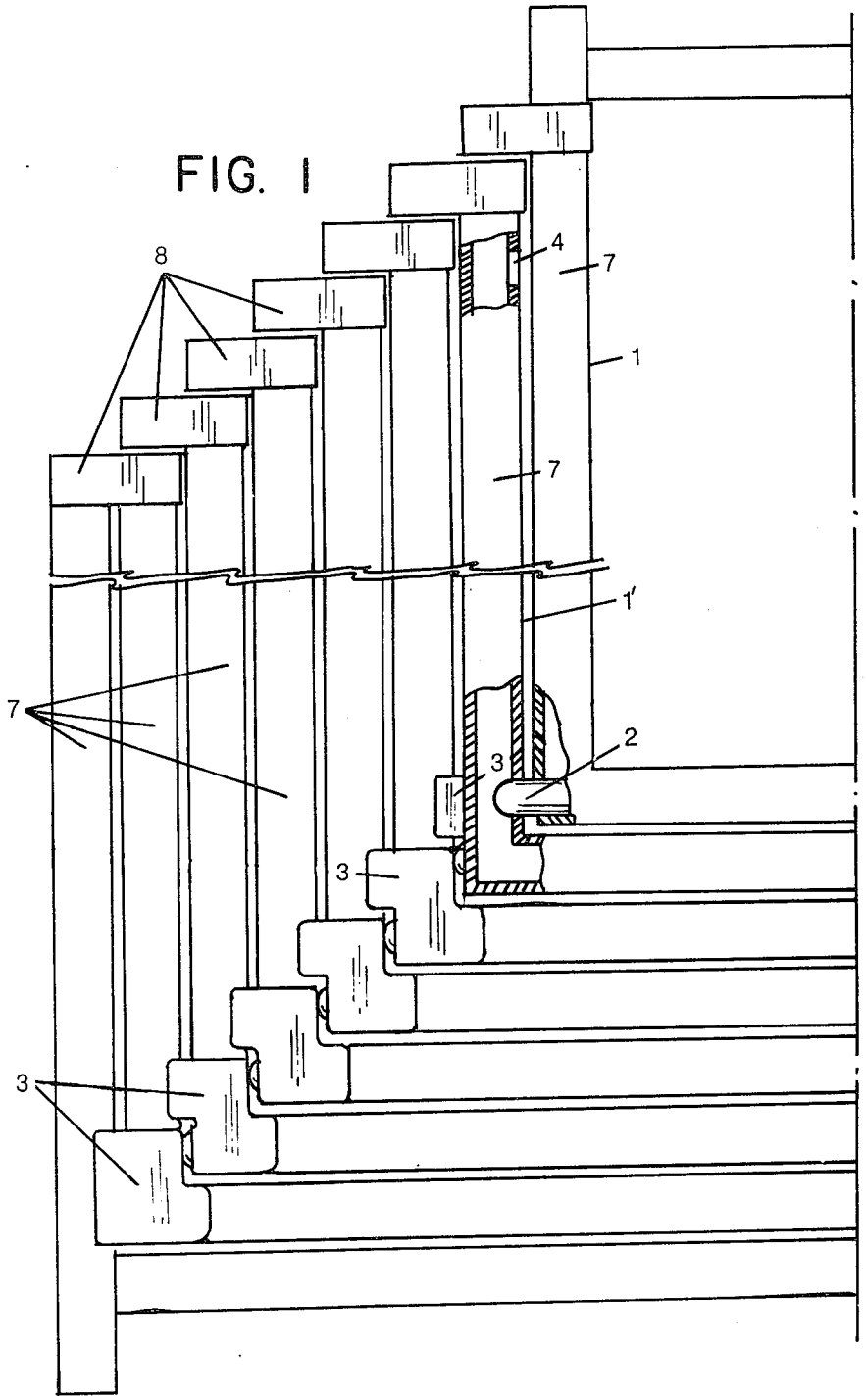
FIG. 1 shows the longitudinal half of the new ladder in the closed or folded position.
Figure 2:
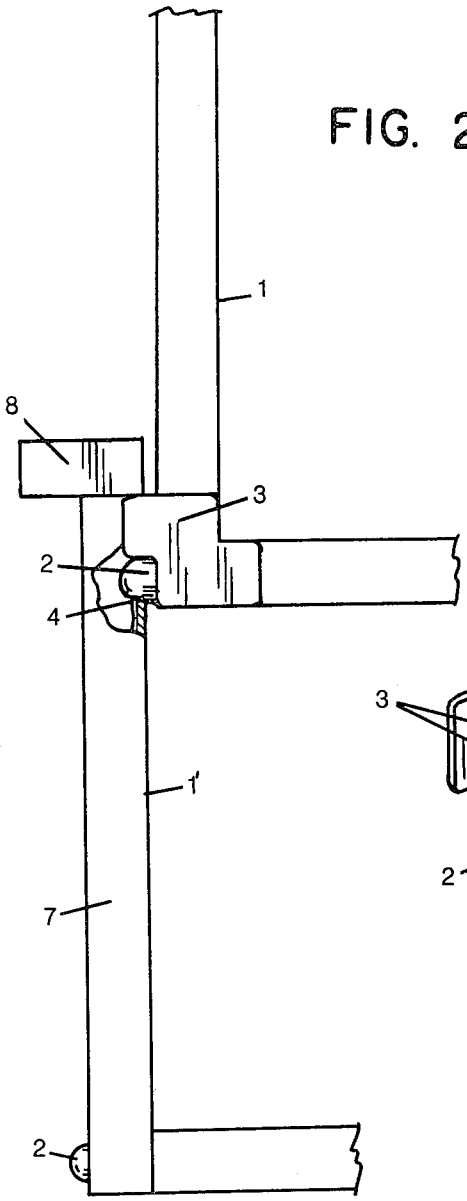
FIG. 2 shows a detail of the connection of one half of a section in relation to the half of the other when ladder is in open position.
Figure 3:
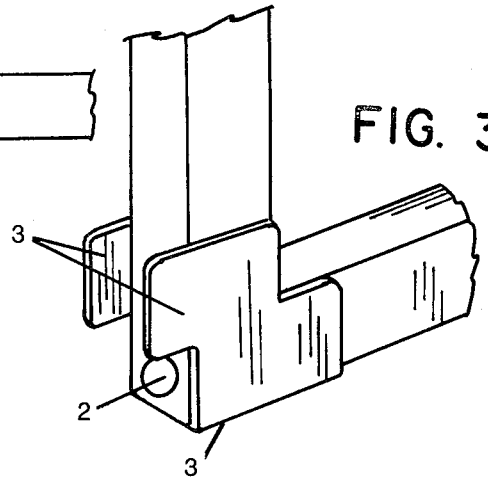
FIG. 3 shows a larger scale detail of the connecting flange and sliding guide formed in this case by two pairs of projecting lugs.

The invention consists of each section being made up of a "U" module (1) comprising a base and upright sections. Each module being smaller in size with regard to the one immediately before it, the sides or upright sections of the smaller module (1) backing on to the sides or upright sections of the immediately larger module (1'), and there being male attaching elements (2) in the position of maximum working extension of one module (1) with regard to the one immediately preceding it, with, also, sliding guide and linking female flanges (3) of one module in relation to the other in order to determine a set of modules related one to the other and all being contained, when the ladder is folded up, in the largest module, this set being extendable through the pulling of one of the end modules, like a fold-up, extendable garland.

One of the means of locking and fastening are retractable spigots or male elements (2) that emerge from the external sides of the internal module and fit into their anchoring position in each of the holes or female receiving elements (4) provided in the side surfaces of the external module.

Likewise, if desired, the locking and fastening elements (2) go through the external well of the larger module and then through the locking holes that in this case are made in the external walls of the sides of the internal modules, and are secured to same, by actually screwing in.

The guide lugs (3) are placed at the angle of join of the arms vertical to the bottom cross member, there being two pairs of right-angled lugs jutting out, one at the bottom (5) and the other at the top (6), the bottom one joined to and lying against its own base cross member and the top one directed, lying against and supported on the surface (7) of each vertical side of the immediate "U" module (1).

There are also some stops (8) placed at the ends of the vertical arms of the "U" modules that allow the end of the arm to swing towards one side and not the other, so that when the ladder is folded up, the modules, besides retention through locking of the fastening elements (2), have at their end the necessary support for limiting, in one direction, the swinging of their ends.

DESCRIPTION OF THE PREFERRED EMBODIMENTS

The preferred embodiment for the upright sliding sections of the present invention are described as follows:

This new upright section in this preferred embodiment enables the partial extension of an upright to be carried out automatically through correct guiding and without bothersome jamming.

Figure 4:
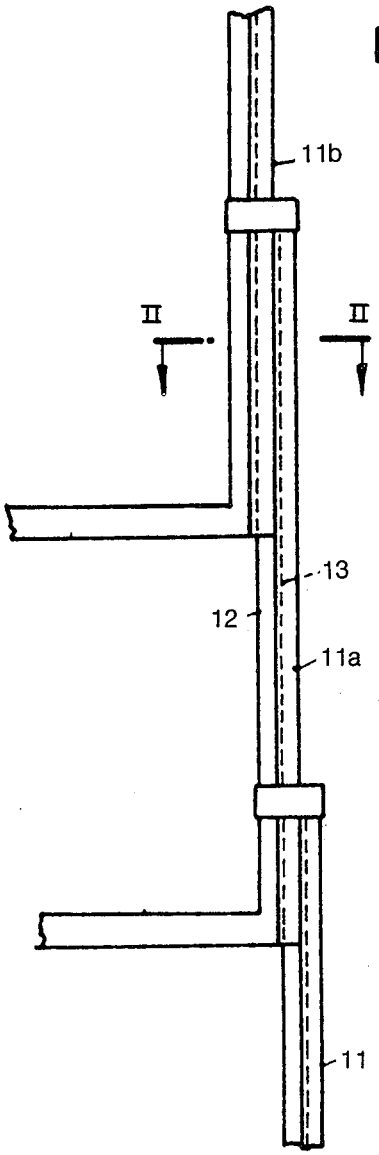
Figure 5:
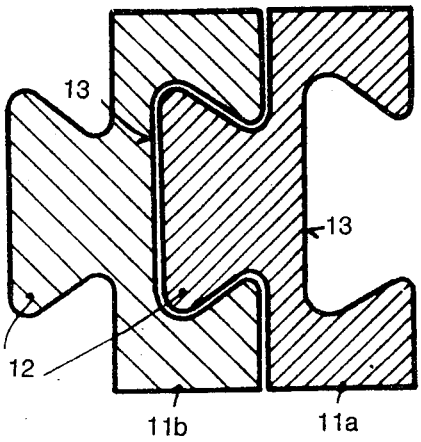

For purposes of correct interpretation, a case of practical execution of the new upright is described below, as a non-restrictive example, and is accompanied by drawings on which FIG. 4 shows part of said upright, more and less extended, and FIG. 5 shows a cross-section, on a larger scale, through the line II—II.

The invention with the preferred slidable upright section consists of the larger surfaces of each section (11) of sliding upright being fitted on one surface with some projections (12) along said surface, and the opposite surface being provided with a recess (13) large enough to allow the projection (12) of one surface of a section (**11*a*) to fit into the corresponding hollow (13) of the immediate section (11*b*), acting, moreover, as a means of guiding the correct sliding of one section (11*a*) in relation to the other immediate one (11*b***), without lateral deviation.

It is understood that in this case all those details of construction and finish that do not alter, change or modify the essential aspect of the invention shall be included within this invention.

I claim:

1. A new sliding section ladder, comprising sections of varying widths made up of u-shaped modules, comprising a base and upright sections, each module being smaller in width than the one immediately before it, the outer sides of the smaller module backing into the inside of the immediately larger module, whereby the base and upright sections of the u-configuration of the smaller module are adjacent to the u-shaped base and upright sections of the larger module when said ladder is in a closed position and wherein said base sections decrease in width as they approach the top of said ladder when said ladder is in an open position.

2. The ladder of claim 1 wherein the bottom outside portion of said u-shaped module has a male attaching element adapted to mate with a female receiving element located in the next adjacent module.

3. The ladder of claim 1 wherein the upright sliding sections are provided on one surface with a projecting portion adapted to fit and slide in a recessed portion of the upright section in the next adjacent module.

4. The ladder of claim 1 wherein said bases of each module are located in the extreme distant position away from the base section of the next adjacent module, when the ladder is in the open position.

5. The ladder of claim 1 wherein said base sections decline in width as the u-shaped modules approach the top of said ladder.

6. The ladder of claim 1 wherein said base sections of said u-shaped modules increase in width as said modules approach the bottom of said ladder.

7. The ladder of claim 1 wherein when in said closed position resemble a series of u-shaped elements each positioned substantially within the next adjacent u-shaped element.

8. The ladder of claim 1 wherein when in an open position resemble a series of u-shaped elements, wherein the base portion of the u is locked into the upright sections of said u closest to the top.

9. A collapsible ladder comprising U-shaped modules of varying size, said modules comprising a base-rung portion and two vertical sections, said modules decreasing in size as they approach the top of said collapsible ladder, wherein the smallest in size is the uppermost module, and the largest in size is the lowermost module, each module except for said lowermost module being movably positioned within the next adjacent larger module, said smaller movable modules slidably connected at their outside vertical sections to the inside vertical sections of said next adjacent larger module and wherein the bottom of said base-rung portions of said smaller modules are adjacent to the top of said base-rung portions of said larger modules when said ladder is in a closed position.

10. The ladder of claim 9 wherein said vertical sliding sections are provided on one surface with a projecting portion adapted to fit and mate with a recessed portion of the vertical section in the next adjacent module.

11. The ladder of claim 9 wherein said modules comprise in their lower portions a locking element adapted to mate with and lock into a corresponding mating element in the next adjacent module.

12. The ladder of claim 9 wherein each of said vertical and said base-rung portions of the smaller modules are immediately adjacent to the corresponding sections in the next adjacent module when said ladder is in the closed or collapsed position.

13. The ladder of claim 9 wherein when in a collapsed position resemble a plurality of U-shaped elements each positioned substantially within the inner periphery of the next adjacent larger module.

14. The ladder of claim 9 wherein when in an extended or open position resemble a plurality of U-shaped elements wherein the lower section of the smaller U is locked into the upper section of said vertical portion of the larger adjacent U.

* * * * *